US010913141B2

(12) United States Patent
Iida et al.

(10) Patent No.: US 10,913,141 B2
(45) Date of Patent: Feb. 9, 2021

(54) IMPACT TOOL

(71) Applicant: MAKITA CORPORATION, Anjo (JP)

(72) Inventors: Hitoshi Iida, Anjo (JP); Masanori Furusawa, Anjo (JP); Hirokatsu Yamamoto, Anjo (JP); Ryo Umemoto, Anjo (JP); Yoshinori Sasaki, Anjo (JP); Akira Naito, Anjo (JP)

(73) Assignee: MAKITA CORPORATION, Anjo (JP)

( * ) Notice: Subject to any disclaimer, the term of this patent is extended or adjusted under 35 U.S.C. 154(b) by 260 days.

(21) Appl. No.: 15/946,029

(22) Filed: Apr. 5, 2018

(65) Prior Publication Data

US 2018/0297186 A1 Oct. 18, 2018

(30) Foreign Application Priority Data

Apr. 18, 2017 (JP) ..... 2017-082065
Aug. 7, 2017 (JP) ..... 2017-152261

(51) Int. Cl.
*B25D 17/24* (2006.01)
*B25D 16/00* (2006.01)
*B25D 17/04* (2006.01)

(52) U.S. Cl.
CPC ..... *B25D 17/24* (2013.01); *B25D 16/003* (2013.01); *B25D 16/006* (2013.01); *B25D 17/04* (2013.01); *B25D 2211/068* (2013.01); *B25D 2216/0015* (2013.01); *B25D 2216/0023* (2013.01); *B25D 2216/0084* (2013.01); *B25D 2250/085* (2013.01); *B25D 2250/121* (2013.01); *B25D 2250/145* (2013.01); *B25D 2250/201* (2013.01);

(Continued)

(58) Field of Classification Search
CPC ..... B25D 2250/221; B25D 11/125; B25D 2250/201; B25D 2211/003; B25D 17/24; B25F 5/00
See application file for complete search history.

(56) References Cited

U.S. PATENT DOCUMENTS

2005/0023017 A1* 2/2005 Sakai ..... B25D 17/24 173/201
2007/0007841 A1* 1/2007 Tamaoka ..... H02K 5/1675 310/156.45

(Continued)

FOREIGN PATENT DOCUMENTS

JP 2011-131364 A 7/2011

*Primary Examiner* — Andrew M Tecco
*Assistant Examiner* — Nicholas E Igbokwe
(74) *Attorney, Agent, or Firm* — Oliff PLC

(57) ABSTRACT

An impact tool includes a motor, a driving mechanism, and a vibration sensor. The driving mechanism is configured to perform a hammering operation of linearly driving a tool accessory along an impact-axis by power of the motor. The impact-axis extends in a front-rear direction of the impact tool. The vibration sensor is configured to detect vibrations. The vibration sensor is disposed such that the vibration sensor is capable of detecting vibrations of a first frequency among vibrations caused in the impact tool, and such that transmission of vibrations of a second frequency to the vibration sensor is suppressed. The vibrations of the first frequency result from the hammering operation. The second frequency is different from the first frequency.

7 Claims, 10 Drawing Sheets

(52) U.S. Cl.
CPC .. *B25D 2250/221* (2013.01); *B25D 2250/255* (2013.01)

(56) References Cited

U.S. PATENT DOCUMENTS

| | | | | |
|---|---|---|---|---|
| 2012/0279740 | A1* | 11/2012 | Furusawa | B25D 17/24 173/79 |
| 2013/0264894 | A1* | 10/2013 | Kim | H01F 41/02 310/44 |
| 2015/0158170 | A1* | 6/2015 | Nitsche | B25D 17/24 173/1 |
| 2015/0246438 | A1* | 9/2015 | Aoki | B25D 11/005 173/2 |
| 2016/0129576 | A1* | 5/2016 | Nishikawa | B25D 17/11 173/2 |

* cited by examiner

IMPACT TOOL

CROSS-REFERENCE TO RELATED APPLICATION

The present application claims priorities to Japanese patent application No. 2017-082065 filed on Apr. 18, 2017 and Japanese patent application No. 2017-152261 filed on Aug. 7, 2017. The contents of the foregoing applications are incorporated fully herein by reference.

TECHNICAL FIELD

The present invention relates to an impact tool that is configured to linearly drive a tool accessory along a prescribed impact-axis.

BACKGROUND

An impact tool is known which performs a processing operation on a workpiece by linearly driving a tool accessory along a prescribed impact-axis. Generally, such an impact tool is equipped with various precision apparatus for controlling operations of the impact tool. For example, Japanese non-examined laid-open patent publication No. 2011-131364 discloses an impact tool which is equipped with a controller for controlling a motor.

SUMMARY

In the above-described impact tool, the controller is housed within a rear cover fixed to a motor housing. In an impact tool in which relatively large vibrations are caused by driving of a tool accessory, however, it is desired to appropriately protect a precision apparatus such as a controller from the vibrations.

Accordingly, it is an object of the present invention to provide a technique which may contribute to rational protection of a precision apparatus from vibrations in an impact tool which is configured to linearly drive a tool accessory along a prescribed impact-axis.

According to one aspect of the present invention, an impact tool is provided which is configured to linearly drive a tool accessory. This impact tool includes a motor, a driving mechanism and a vibration sensor.

The driving mechanism is configured to perform a hammering operation of linearly driving the tool accessory along an impact-axis by power of the motor. The impact-axis extends in a front-rear direction of the impact tool. The vibration sensor is configured to detect vibrations. Further, the vibration sensor is disposed such that the vibration sensor is capable of detecting vibrations of a first frequency among vibrations caused in the impact tool, and such that transmission of vibrations of a second frequency to the vibration sensor is suppressed. The vibrations of the first frequency result from the hammering operation. The second frequency is different from the first frequency.

Generally, in order to reduce the possibility of malfunction, it is preferable for a precision apparatus in an impact tool to be arranged such that vibration transmission is suppressed as much as possible. As for the vibration sensor, however, if vibration transmission is uniformly suppressed, it has a higher possibility of failing to obtain a proper detection result. In the impact tool of the present aspect, however, the vibration sensor is protected from the vibrations of the second frequency different from the first frequency, while being capable of detecting the characteristic vibrations in the impact tool, that is, the vibrations of the first frequency which are caused by the hammering operation. Therefore, according to the present aspect, the vibration sensor, which is an example of a precision apparatus mounted on the impact tool, can be rationally protected. It is noted that the "first frequency" and the "second frequency" as used herein may each refer to a frequency band having a certain degree of width.

According to one aspect of the present invention, the motor may be configured as a brushless motor having a stator, a rotor and a motor shaft extending from the rotor. The vibrations of the second frequency may be vibrations resulting from electromagnetic vibrations of the motor. Further, the second frequency may be a frequency that is defined according to the number of poles formed in the rotor.

According to one aspect of the present invention, the motor may be arranged such that a rotation axis of the motor shaft extends in a direction crossing the impact-axis. Further, the vibration sensor may be at least partly disposed within a range of a length of the motor shaft in an extending direction of the rotation axis.

According to one aspect of the present invention, the vibration sensor may be disposed behind the motor in the front-rear direction.

According to one aspect of the present invention, the impact tool may further include a first housing which houses the motor and the driving mechanism. The vibration sensor may be held on the first housing via at least one elastic element.

According to one aspect of the present invention, the at least one elastic element may include a first elastic element and a second elastic element. The vibration sensor may be held on the first housing while being held between the first elastic element and the second elastic element in the front-rear direction.

According to one aspect of the present invention, the first elastic element and the second elastic element may be connected via a connection part.

According to one aspect of the present invention, the impact tool may further include a grip part that extends in an up-down direction orthogonal to the impact-axis. The grip part is configured to be held by a user. The at least one elastic element may include a pair of elastic elements. When a direction that is orthogonal to the front-rear direction and the up-down direction is defined as a left-right direction, the pair of elastic elements may be respectively engaged with right and left end portions of the vibration sensor.

According to one aspect of the present invention, each of the pair of elastic elements may have a pair of inclined surfaces. The pair of inclined surfaces may be inclined toward each other in the up-down direction as the inclined surfaces extend away from the vibration sensor in the left-right direction. Further, each of the pair of elastic elements may be engaged with the first housing via the inclined surfaces.

According to one aspect of the present invention, the impact tool may further include a grip part that is configured to be held by a user. The grip part may be connected to the first housing via another elastic element such that the grip part is movable relative to the first housing.

According to one aspect of the present invention, the impact tool may further include a second housing and a controller. The second housing may be connected to the first housing via another elastic element such that the second housing is movable relative to the first housing. The controller may be configured to control driving of the motor based on a detection result of the vibration sensor. Further, the controller may be housed in the second housing.

DETAILED DESCRIPTION OF THE EMBODIMENTS

Embodiments of the present invention are described below with reference to the drawings. In the following embodiments, a hammer drill is described as an example of an impact tool.

First Embodiment

A hammer drill 1 according to a first embodiment is described below with reference to FIGS. 1 to 5. The hammer drill 1 of the present embodiment is configured to perform an operation (hereinafter referred to as a hammering operation) of linearly driving a tool accessory 91 coupled to a tool holder 34 along a prescribed driving axis A1, and an operation (hereinafter referred to as a drilling operation) of rotationally driving the tool accessory 91 around the driving axis A1.

Figure 1:
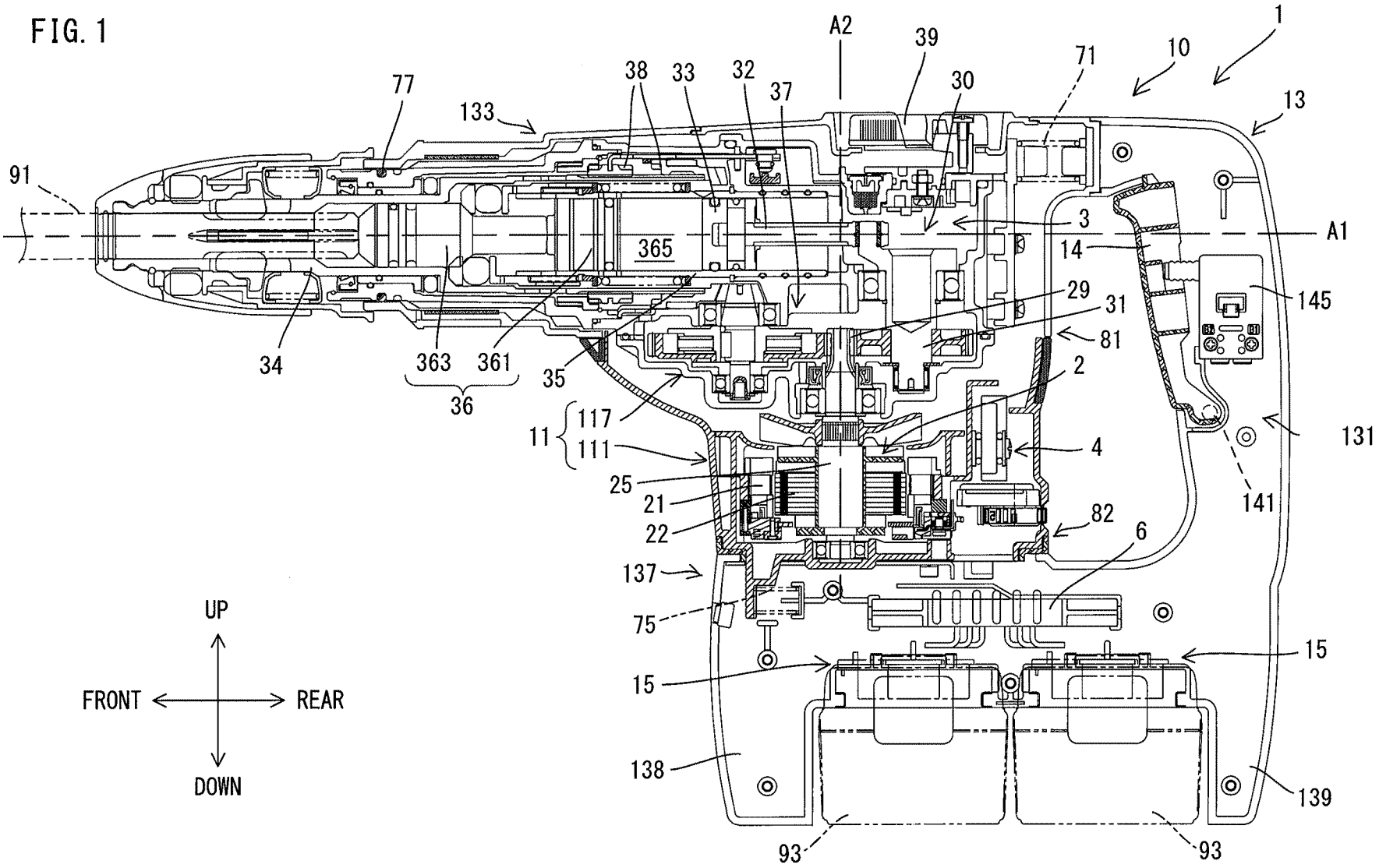
FIG. 1 is a longitudinal section view of a hammer drill according to a first embodiment.

First, the general structure of the hammer drill 1 is described with reference to FIG. 1. As shown in FIG. 1, an outer shell of the hammer drill 1 is mainly formed by a housing 10. The housing 10 of the present embodiment is configured as a so-called vibration-isolating housing. Specifically, the housing 10 includes a first housing 11 and a second housing 13. The second housing 13 is elastically connected to the first housing 11 such that the second housing 13 is movable relative to the first housing 11.

The first housing 11 includes a motor housing part 111 that houses a motor 2, and a driving mechanism housing part 117 that houses a driving mechanism 3. The first housing 11 is generally L-shaped as a whole. The driving mechanism housing part 117 has an elongate shape extending in a direction of the driving axis A1 (also referred to as a driving axis A1 direction). A tool holder 34, to which the tool accessory 91 can be removably coupled, is disposed in one end region of the driving mechanism housing part 117 in the driving axis A1 direction. Further, the tool holder 34 is held by the first housing 11 to be rotatable around the driving axis A1. The tool holder 34 is configured to hold the tool accessory 91 such that the tool accessory 91 cannot rotate and can linearly move in the driving axis A1 direction. The motor housing part 111 is fixedly and immovably connected to the other end region of the driving mechanism housing part 117 in the driving axis A1 direction. The motor housing part 111 is arranged to protrude in a direction crossing the driving axis A1 and away from the driving axis A1. The motor 2 is disposed within the motor housing part 111 such that a rotation axis A2 of a motor shaft 25 extends in a direction crossing (specifically, a direction orthogonal to) the driving axis A1.

In the following description, for the sake of explanation, the direction of the driving axis A1 of the hammer drill 1 is defined as a front-rear direction of the hammer drill 1. In the front-rear direction, one end side of the hammer drill 1 on which the tool holder 34 is disposed is defined as a front side (also referred to as a front end region side) of the hammer drill 1 and the opposite side is defined as a rear side. Further, an extending direction of the rotation axis A2 (also referred to as a rotation axis A2 direction) of the motor shaft 25 is defined as an up-down direction of the hammer drill 1. In the up-down direction, a direction toward which the motor housing part 111 protrudes from the driving mechanism housing part 117 is defined as a downward direction and the opposite direction is defined as an upward direction. Furthermore, a direction orthogonal to both the front-rear direction and the up-down direction is defined as a left-right direction.

The second housing 13 includes a grip part 131, an upper part 133 and a lower part 137. The second housing 13 is generally U-shaped as a whole. The grip part 131 is configured to be held by a user. The grip part 131 is a portion that is arranged to extend in the direction of the rotation axis A2 of the motor shaft 25 (that is, in the up-down direction). More specifically, the grip part 131 is arranged apart rearward from the first housing 11 and extends in the up-down direction. A trigger 14, which can be pressed (pulled) with a user's finger, is provided on a front portion of the grip part 131. The upper part 133 is a portion that is connected to an upper end portion of the grip part 131. In the present embodiment, the upper part 133 is configured to extend forward from the upper end portion of the grip part 131 and cover most of the driving mechanism housing part 117 of the first housing 11. The lower part 137 is a portion that is connected to a lower end portion of the grip part 131. In the resent embodiment, the lower part 137 extends forward from the lower end portion of the grip part 131 and is arranged on a lower side of the motor housing part 111. Battery mounting parts 15 are provided on a lower end portion of a central portion of the lower part 137 in the front-rear direction. The hammer drill 1 is operated by power supply from batteries 93 mounted to the battery mounting parts 15.

With the above-described structure, in the hammer drill 1, the motor housing part 111 of the first housing 11 is arranged between the upper part 133 and the lower part 137 in the up-down direction and exposed to the outside. The second housing 13 and the motor housing part 111 together form an outer surface of the hammer drill 1.

The detailed structure of the hammer drill 1 is described below. First, a vibration-isolating housing structure of the housing 10 is briefly described with reference to FIG. 1. As described above, in the housing 10, the second housing 13 including the grip part 131 is elastically connected to the first housing 11 which houses the motor 2 and the driving mechanism 3, such that the second housing 13 is movable relative to the first housing 11. With this elastically connecting structure, transmission of vibrations from the first housing 11 to the second housing 13 (to the grip part 131, in particular) can be suppressed.

More specifically, as shown in FIG. 1, a pair of right and left first springs 71 are disposed between the driving mechanism housing part 117 of the first housing 11 and the upper part 133 of the second housing 13. Further, a second spring 75 is disposed between the motor housing part 111 of the first housing 11 and the lower part 137 of the second housing 13. In the present embodiment, the first springs 71 and the second spring 75 are configured as compression coil springs. The first and second springs 71 and 75 bias the first housing 11 and the second housing 13 in a direction to separate the grip part 131 away from the first housing 11 in the driving axis A1 direction. In addition to these springs, an O-ring 77, which is formed of an elastic material, is disposed between a front end portion of the driving mechanism housing part 117 and a cylindrical front portion of the upper part 133.

Further, the upper part 133 and the lower part 137 are configured to be slidable relative to the upper and lower end portions of the motor housing part 111, respectively. More specifically, a lower surface of the upper part 133 and an upper end surface of the motor housing part 111 are configured as sliding surfaces to make sliding contact with each other in the driving axis A1 direction. The lower surface of the upper part 133 and the upper end surface of the motor housing part 111 form an upper sliding part 81. Further, an upper surface of the lower part 137 and a lower end surface of the motor housing part 111 are configured as sliding surfaces to make sliding contact with each other in the driving axis A1 direction. The upper surface of the lower part 137 and the lower end surface of the motor housing part 111 form a lower sliding part 82. Each of the upper sliding part 81 and the lower sliding part 82 serves as a sliding guide for guiding the first housing 11 and the second housing 13 to move relative to each other in the driving axis A1 direction. With this sliding guide function, the vibrations in the driving axis A1 direction, which are the largest and most dominant vibrations caused during the hammering operation, can be effectively prevented from being transmitted to the grip part 131.

Figure 2:
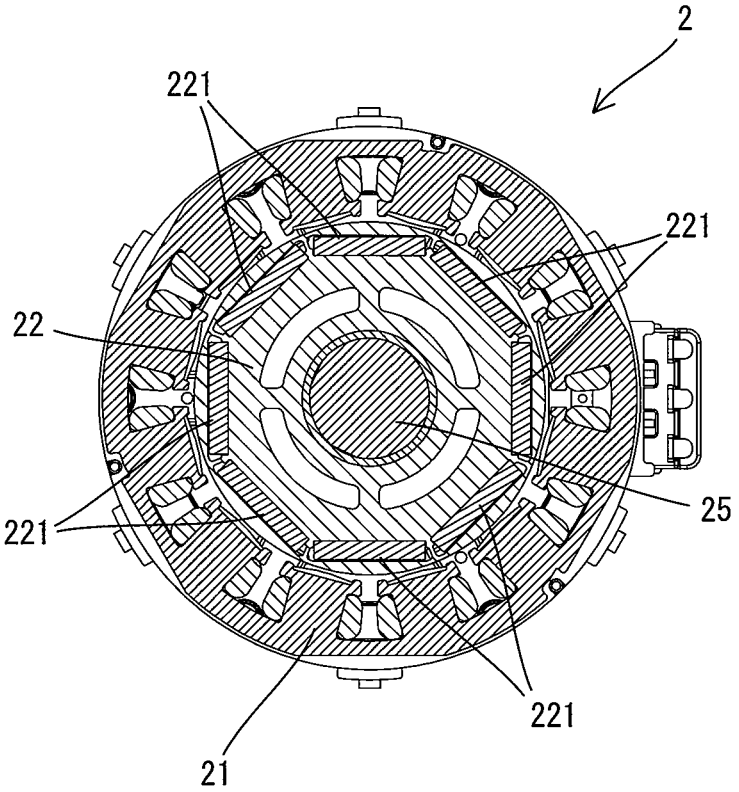
FIG. 2 is a cross-sectional view of a motor.

The detailed structure of the first housing 11 and its internal configuration are now described with reference to FIGS. 1 to 3.

First, the motor housing part 111 and its internal configuration are described. As shown in FIG. 1, the motor housing part 111 has a rectangular hollow cylinder shape having a bottom and an open top. The motor 2 is housed in the motor housing part 111. In the present embodiment, a compact and high-output brushless motor having a stator 21, a rotor 22 and a motor shaft 25 extending from the rotor 22 is employed as the motor 2. The motor shaft 25, which extends in the up-down direction, is rotatably supported at its upper and lower end portions by bearings. A driving gear 29 is provided on the upper end portion of the motor shaft 25, which protrudes into the driving mechanism housing part 117. Further, as shown in FIG. 2, eight housing holes are formed in the rotor 22 in a circumferential direction around the rotation axis A2. A permanent magnet 221 is embedded in each of the holes. With this structure, the motor 2 is configured as an embedded-magnet type eight-pole brushless motor.

Figure 3:
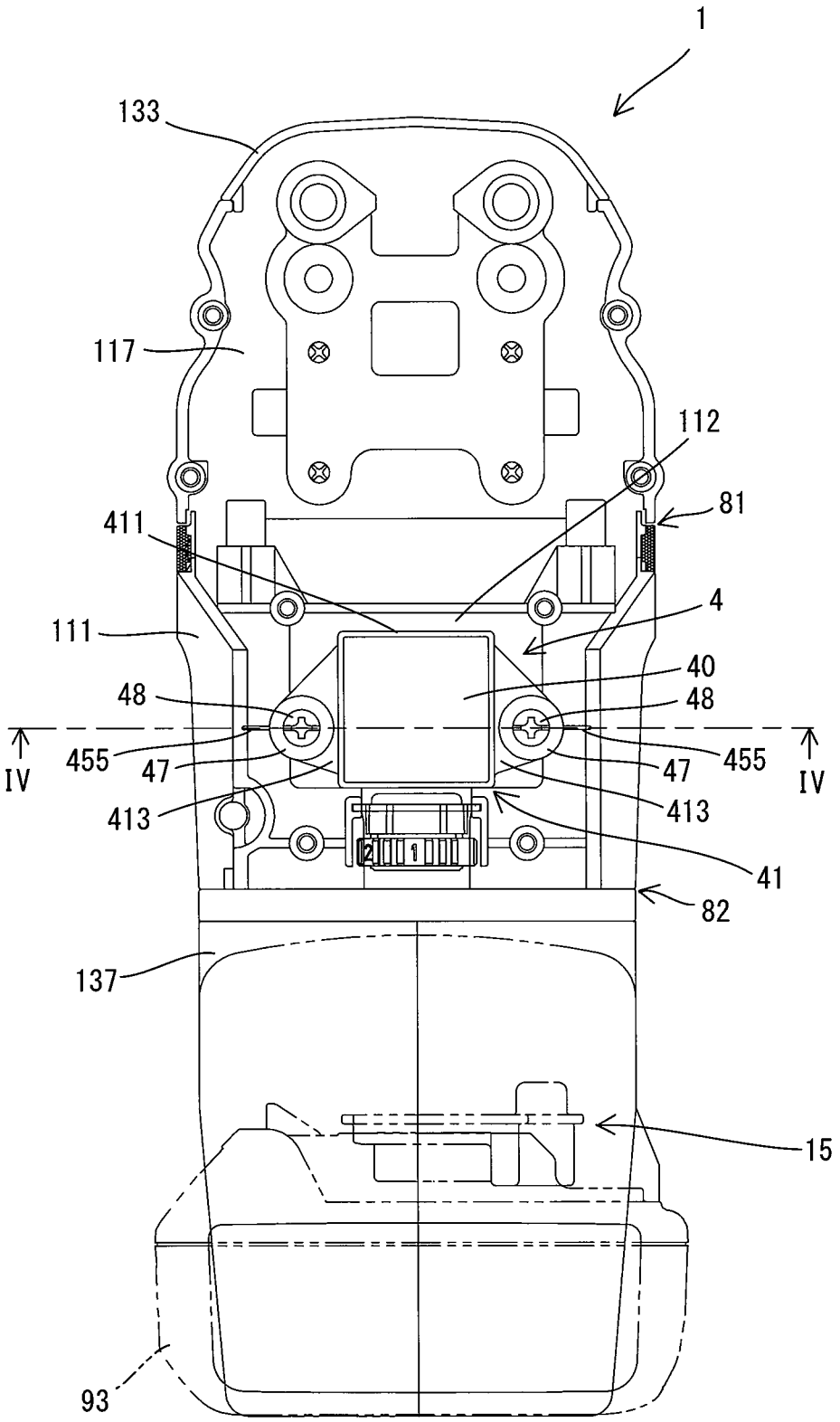
FIG. 3 is an explanatory drawing showing an internal configuration of the hammer drill in rear view, with part of a housing removed therefrom.

As shown in FIGS. 1 and 3, a vibration sensor unit 4 is held on the motor housing part 111. In the present embodiment, the vibration sensor unit 4 is disposed within a range of a length of the motor shaft 25 in the up-down direction. Further, the vibration sensor unit 4 is disposed behind the motor in the front-rear direction. More specifically, an inner wall 112 is provided within the motor housing part 111 and arranged orthogonally to the front-rear direction (such that a normal of the inner wall 112 extends in the front-rear direction). The vibration sensor unit 4 is held on a rear surface of the inner wall 112, above the stator 21 and the rotor 22, and behind the stator 21. The structure of the vibration sensor unit 4 and a structure for holding the vibration sensor unit 4 will be described later in detail.

The driving mechanism housing part 117 and its internal configuration are now described. As shown in FIG. 1, a lower end region of a rear portion of the driving mechanism housing part 117 is disposed within an upper end portion of the motor housing part 111, and the driving mechanism housing part 117 is fixedly and immovably connected to the motor housing part 111. A driving mechanism 3, which is configured to drive the tool accessory 91 by power of the motor 2, is housed in the driving mechanism housing part 117. In the present embodiment, the driving mechanism 3 includes a motion converting mechanism 30, a striking mechanism 36 and a rotation transmitting mechanism 37. The motion converting mechanism 30 and the striking mechanism 36 are configured to perform the hammering operation of linearly driving the tool accessory 91 along the driving axis A1. The rotation transmitting mechanism 37 is configured to perform the drilling operation of rotationally driving the tool accessory 91 around the driving axis A1.

The motion converting mechanism 30 is configured to convert a rotational motion of the motor 2 into a linear motion and transmit it to the striking mechanism 36. In the present embodiment, the motion converting mechanism 30 is configured as a crank mechanism. More specifically, the motion converting mechanism 30 includes a crank shaft 31, a connecting rod 32, a piston 33 and a cylinder 35. The crank shaft 31 is arranged in parallel to the motor shaft 25 in a rear end region of the driving mechanism housing part 117. The crank shaft 31 has a driven gear 311 which is engaged with the driving gear 29, and an eccentric pin. One end portion of the connecting rod 32 is connected to the eccentric pin and the other end portion is connected to the piston 33 via a connecting pin. The piston 33 is slidably disposed within the cylinder 35 having a circular cylindrical shape. The cylinder 35 is coaxially and fixedly connected to a rear portion of the tool holder 34 which is disposed within the front end region of the driving mechanism housing part 117. When the motor 2 is driven, the piston 33 is caused to reciprocate within the cylinder 35 in the direction of the driving axis A1.

The striking mechanism 36 is configured to linearly move to strike the tool accessory 91 and thereby linearly drive the tool accessory 91 along the driving axis A1. In the present embodiment, the striking mechanism 36 includes a striker 361 and an impact bolt 363. The striker 361 is disposed within the cylinder 35 so as to be slidable in the direction of the driving axis A1. An air chamber 365 is formed between the striker 361 and the piston 33 and serves to linearly move the striker 361 configured as a striking element, via air pressure fluctuations caused by a reciprocating movement of the piston 33. The impact bolt 363 is configured as an intermediate element for transmitting kinetic energy of the striker 361 to the tool accessory 91 and disposed within the tool holder 34 so as to be slidable in the direction of the driving axis A1.

When the motor 2 is driven and the piston 33 is moved forward, air in the air chamber 365 is compressed so that the internal pressure increases. Therefore, the striker 361 is pushed forward at high speed and collides with the impact bolt 363, thereby transmitting its kinetic energy to the tool accessory 91. As a result, the tool accessory 91 is linearly driven along the driving axis A1 and strikes a workpiece. On the other hand, when the piston 33 is moved rearward, the air in the air chamber 365 expands so that the internal pressure decreases and the striker 361 is retracted rearward. By repeating such operations, the motion converting mechanism 30 and the striking mechanism 36 perform the hammering operation.

The rotation transmitting mechanism 37 is configured to transmit the rotating power of the motor shaft 25 to the tool holder 34. In the present embodiment, the rotation transmitting mechanism 37 is configured as a gear speed reducing mechanism including a plurality of gears to appropriately decelerate the rotation speed and transmit the rotating power of the motor 2 to the tool holder 34. Further, an engagement clutch 38 is disposed on a power transmission path of the rotation transmitting mechanism 37. When the clutch 38 is engaged, the rotation transmitting mechanism 37 transmits the rotating power of the motor shaft 25 to the tool holder 34 and thereby performs the drilling operation of rotationally driving the tool accessory 91 coupled to the tool holder 34 around the driving axis A1. On the other hand, when the clutch 38 is disengaged (as shown in FIG. 1), power transmission to the tool holder 34 via the rotation transmitting mechanism 37 is interrupted, so that the tool accessory 91 is not rotationally driven.

The hammer drill 1 of the present embodiment is configured such that one of two operation modes, that is, a hammer drill mode and a hammer mode, can be selected by operating a mode switching dial 39 which is rotatably disposed on the top of the driving mechanism housing part 117. In the hammer drill mode, the clutch 38 is engaged and the motion converting mechanism 30 and the rotation transmitting mechanism 37 are driven, so that the hammering operation and drilling operation are performed. In the hammer mode, the clutch 38 is disengaged and only the motion converting mechanism 30 is driven, so that only the hammering operation is performed. A clutch switching mechanism, which is connected to the mode switching dial 39, is provided within the first housing 11 (specifically, within the driving mechanism housing part 117). The clutch switching mechanism is configured to switch the clutch 38 between the engaged state and the disengaged state according to the selected switching position when a hammer drilling position or hammering position is selected with the mode switching dial 39. The structure of the clutch switching mechanism is well known, and therefore it is not described here in further detail and not shown in the drawings.

The detailed structure of the second housing 13 and its internal configuration are now described with reference to FIG. 1.

First, the upper part 133 and its internal configuration are described. As shown in FIG. 1, a rear portion of the upper part 133 has a generally rectangular box-like shape having an open bottom and covers a rear portion (more specifically, a portion in which the motion converting mechanism 30 and the rotation transmitting mechanism 37 are housed) of the driving mechanism housing part 117 from above. Further, a front portion of the upper part 133 is cylindrically shaped and covers an outer periphery of a front portion of the driving mechanism housing part 117 (more specifically, a portion of the driving mechanism housing part 117 in which the tool holder 34 is housed). An opening is formed in an upper surface of the rear portion of the upper part 133. The mode switching dial 39 is provided on the top of the driving mechanism housing part 117 and is exposed to the outside through the opening.

The grip part 131 and its internal configuration are now described. As shown in FIG. 1, the trigger 14 which can be pressed by the user is provided on the front portion of the grip part 131. A switch 145 is provided within the hollow cylindrical grip part 131. The switch 145 is configured to be switched between an on-state and an off-state in response to an operation of the trigger 14.

The lower part 137 and its internal configuration are now described. As shown in FIG. 1, the lower part 137 has a rectangular box-like shape having a partly open top and is arranged on the lower side of the motor housing part 111. A controller 6 is disposed within the lower part 137. In the present embodiment, a control circuit configured as a microcomputer including a CPU (central processing unit), a ROM (read only memory) and a RAM (random access memory) is employed as the controller 6. The controller 6 is electrically connected to the motor 2, the switch 145, the battery mounting part 15, the vibration sensor unit 4, etc. via wiring (not shown).

The controller 6 is configured to start energization of the motor 2 (that is, driving of the tool accessory 91) when the trigger 14 is pressed and the switch 145 is turned on, and to stop energization of the motor 2 when the trigger 14 is released and the switch 145 is turned off. Further, in the present embodiment, the controller 6 is configured to control the motor 2 to drive at low speed while the motor 2 is under no load after starting driving, and to drive at high speed when the motor 2 is under load. In the present embodiment, when the vibrations resulting from the hammering operation of the driving mechanism 3 exceeds a prescribed range, it is determined that the motor 2 is under load. To this end, in the present embodiment, the vibrations resulting from the hammering operation are detected by the vibration sensor unit 4 described below.

Further, two battery mounting parts 15 are provided on a lower end portion of the central portion of the lower part 137 in the front-rear direction. A rechargeable battery 93 can be removably mounted to each of the battery mounting parts 15. In the present embodiment, the battery mounting parts 15 are arranged side by side in the front-rear direction. The battery 93 is electrically connected to the battery mounting part 15 when the battery 93 is engaged with the battery mounting part 15 by sliding rightward from the left. When two such batteries 93 are mounted to the battery mounting parts 15, lower surfaces of the batteries 93 are flush with each other. Further, a front lower end part 138 and a rear lower end part 139 of the lower part 137 are configured to be arranged respectively on the front side and the rear side of the pair of the batteries 93 such that the lower surfaces of the front and rear lower end parts 138 and 139 are generally flush with the lower surfaces of the batteries 93 when the batteries 93 are mounted to the battery mounting parts 15. The front and rear lower end parts 138 and 139 may serve as battery protection parts for protecting the batteries 93 from external forces.

The structure of the vibration sensor unit 4 and a structure for holding the vibration sensor unit 4 are now described with reference to FIGS. 1 and 3 to 5.

Figure 4:
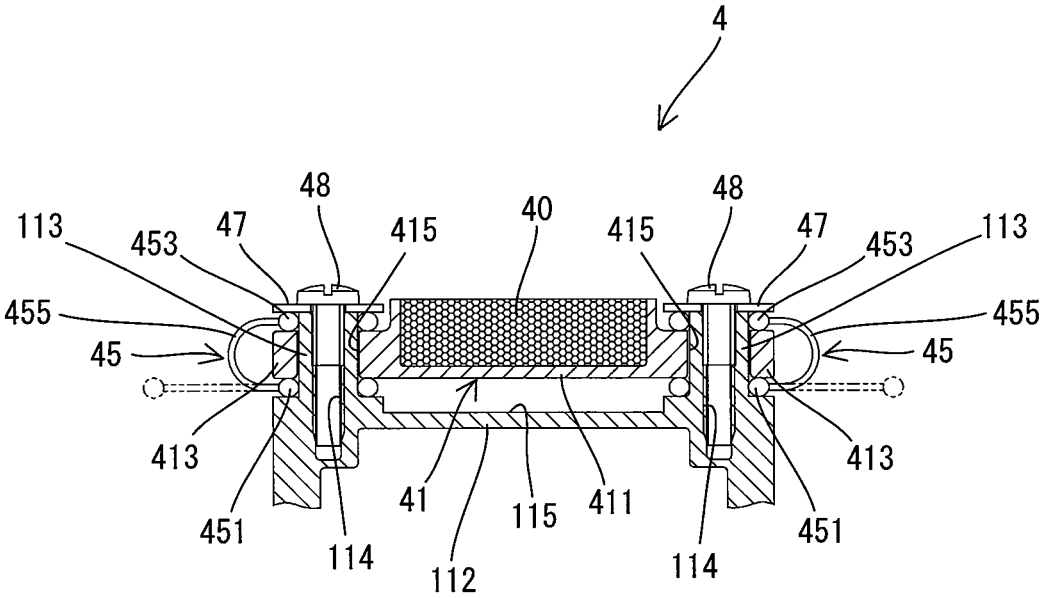
FIG. 4 is a sectional view taken along line IV-IV in FIG. 3.

As shown in FIGS. 3 and 4, in the present embodiment, the vibration sensor unit 4 includes a sensor body 40 and a holding member 41 for holding the sensor body 40. Although not shown in detail, the sensor body 40 includes a vibration sensor configured to detect vibrations and a microcomputer including a CPU, a ROM and a RAM. In the present embodiment, as the vibration sensor, a known acceleration sensor is employed, but a different sensor (such as a speed sensor and a displacement sensor) which is capable of detecting vibrations may be employed. The microcomputer is configured to determine whether or not the vibrations detected by the vibration sensor exceed a prescribed threshold, and to output a signal (off-signal or on-signal) corresponding to a result of the determination to the controller 6 (see FIG. 1). Alternatively, it may be configured such that the sensor body 40 is not provided with the microcomputer and directly outputs a signal indicating a detection result of the vibration sensor to the controller 6 and the controller 6 makes the determination. The holding member 41 has a plate-like shape as a whole. The holding member 41 includes a holding part 411 having a rectangular shape in rear view and a pair of arm parts 413 protruding from the holding part 411 in the left-right direction. The sensor body 40 is held in a recess formed in the holding part 411. Each of the arm parts 413 has a through hole 415.

The inner wall 112 of the motor housing part 111 has a pair of cylindrical parts 113 formed in a region slightly above the stator 21 and the rotor 22. The cylindrical parts 113 are spaced apart from each other in the left-right direction and protruding rearward. The distance between the cylindrical parts 113 is generally equal to the distance between the through holes 415 formed in the arm parts 413 of the holding member 41, and the outer diameter of the cylindrical part 113 is slightly smaller than the diameter of the through hole 415. The protruding length (the length in the front-rear direction) of the cylindrical part 113 is larger than the thickness of the arm part 413 of the holding member 41. A threaded hole 114 is formed in an inner peripheral surface of the cylindrical part 113.

Figure 5:
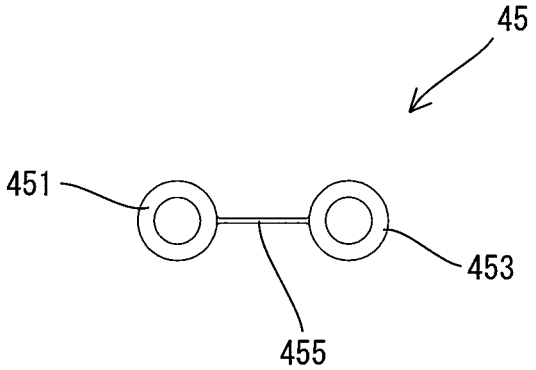
FIG. 5 is an explanatory drawing showing an overall structure of an elastic intervening member.

The vibration sensor unit 4 is held on the inner wall 112 via two elastic intervening members 45. As shown in FIG. 5, in the present embodiment, each of the elastic intervening members 45 includes annular first and second elastic elements 451 and 453 connected with a string-like connection part 455. In the present embodiment, each of the elastic intervening members 45 is configured as one component integrally formed of rubber. Further, the hardness of the rubber is about 50 degrees. As shown in FIG. 4, each of the first and second elastic elements 451 and 453 has a generally circular cross section. The elastic intervening member 45 of the present embodiment can be described as two O-rings connected via a string.

In order to connect the vibration sensor unit 4 to the inner wall 112, first, the first elastic elements 451 of the elastic intervening members 45 are respectively fitted onto the cylindrical parts 113. At this time, the second elastic elements 453 hang down in the vicinity of the cylindrical parts 113 as shown by two-dot chain lines in FIG. 4, since the second elastic elements 453 are connected to the first elastic elements 451 via the connection parts 455. Thereafter, the cylindrical parts 113 are inserted through the through holes 415 of the holding member 41 of the vibration sensor unit 4, respectively. Then the second elastic elements 453 of the elastic intervening members 45 are respectively fitted onto the cylindrical parts 113. Specifically, the vibration sensor unit 4 (the holding member 41) is held between the first and second elastic elements 451 and 453 in the front-rear direction. In this state, a screw 48 is screwed into the threaded hole 114 of the cylindrical part 113 via a washer 47, so that the vibration sensor unit 4 is held on the inner wall 112. When the screw 48 is screwed in, the first and second elastic elements 451 and 453 are held in a slightly compressed state. Further, the connection part 455 connecting the first and second elastic elements 451 and 453 is disposed on a side of the arm part 413.

With such a structure, the vibration sensor unit 4 is held to be movable relative to the inner wall 112 in the front-rear direction (or in the driving axis A1 direction). Further, a recess 115 is formed on a rear side of the inner wall 112.

In the present embodiment, from among the various vibrations caused in the first housing 11, the sensor body (the vibration sensor) 40 needs to reliably detect the vibrations resulting from the hammering operation, which are to be used as a criterion for determining whether or not the motor 2 is under load. To this end, the vibration sensor unit 4 including the sensor body 40 is held in the first housing 11 for housing the driving mechanism 3, which is a vibration source. On the other hand, in order to reduce the possibility of causing malfunction of the sensor body 40 which is a precision apparatus, it is preferred that the other vibrations caused in the first housing 11 are prevented from being transmitted to the sensor body 40 as much as possible.

Generally, the vibrations that result from the hammering operation have a relatively low frequency. In the hammer drill 1 of the present embodiment, the frequency of the vibrations caused by the hammering operation (hereinafter also referred to as hammering frequency) is about 50 Hz. When the motor 2 (see FIG. 2) is driven, the rotor 22 having magnetic force rotates. Along with the rotation of the rotor 22, electromagnetic vibrations occur that have a frequency that is defined according to the number of poles (eight poles in the present embodiment) of the rotor 22, and the electromagnetic vibrations are transmitted to the first housing 11. Other than the vibrations resulting from the hammering operation, the vibrations resulting from the electromagnetic vibrations are relatively large. Further, the vibrations resulting from the electromagnetic vibrations have a frequency that is higher than the hammering frequency. In the present embodiment, the frequency of the vibrations caused by the electromagnetic vibrations of the motor 2 (hereinafter also referred to as electromagnetic vibration frequency) is about 2,400 Hz.

Considering the above-described situation, the vibration sensor unit 4 is held on the inner wall 112 via the elastic intervening members 45 having the above-described structure such that the vibration sensor can detect, from among the vibrations caused in the first housing 11, the vibrations of the first frequency which are caused by the hammering operation of the driving mechanism 3 (specifically, vibrations of frequency bands having a prescribed width and centered on the hammering frequency and its order components), and such that transmission of the vibrations of the second frequency which are caused by the electromagnetic vibrations of the motor 2 (specifically, vibrations of frequency bands having a prescribed width and centered on the electromagnetic vibration frequency and its order components) is suppressed. In other words, the vibrations of the first frequency which are caused by the hammering operation are reliably transmitted to the sensor body 40, while the sensor body 40 is protected from the vibrations of the second frequency which are caused by the electromagnetic vibrations of the motor 2.

Operation of the Hammer Drill 1 is Now Described.

When the user selects one of the hammer drill mode and the hammer mode with the mode switching dial 39 and presses the trigger 14, the controller 6 starts driving of the motor 2 at low speed. Further, as described above, the driving mechanism 3 performs the hammering operation and the drilling operation when the hammer drill mode is selected. Alternatively, the driving mechanism 3 performs only the hammering operation when the hammer mode is selected. Thus, the vibrations resulting from the hammering operation and the electromagnetic vibrations occur in the first housing 11. However, the vibrations of the second frequency resulting from the electromagnetic vibrations and detected by the sensor body 40 are sufficiently reduced to a negligible level by the effect of the above-described elastic intervening members 45, as compared with the vibrations of the first frequency resulting from the hammering operation. Therefore, the vibration sensor of the sensor body 40 can reliably detect the vibrations of the first frequency caused by the hammering operation. In a case where the vibration sensor detects the vibrations exceeding a prescribed threshold, a specific signal for indicating the vibrations exceeding the threshold is outputted from the microcomputer of the sensor body 40 to the controller 6. In response to this signal, the controller 6 changes the rotation speed of the motor 2 to high speed. When the user releases the trigger 4, the controller 6 stops driving of the motor 2.

As described above, in the hammer drill 1 according to the present embodiment, the characteristic vibrations in the hammer drill 1, that is, the vibrations of the first frequency which are caused by the hammering operation of the driving mechanism 3 (specifically, the vibrations of the frequency bands having a prescribed width and centered on the hammering frequency and its order components) can be detected by the vibration sensor unit 4 (the sensor body 40). In addition, the sensor body (the vibration sensor) 40 is protected from the vibrations of the second frequency which are caused by the electromagnetic vibrations of the motor 2 (specifically, the vibrations of a frequency band having a prescribed width and centered on the electromagnetic vibration frequency and its order components). Thus, in the present embodiment, the sensor body (the vibration sensor) 40, which is an example of a precision apparatus, can be rationally protected.

In the present embodiment, the vibration sensor unit 4 is held on the first housing 11 (the inner wall 112) which houses the motor 2 and the driving mechanism 3, via the two elastic intervening members 45 each having the two elastic elements (the first elastic element 451 and the second elastic element 453). Specifically, with a simple holding structure of disposing the elastic intervening members 45 between the vibration sensor unit 4 and the first housing 11, the sensor body (the vibration sensor) 40 can be protected from the vibration of the second frequency caused by the electromagnetic vibrations, while enabling detecting the vibrations of the first frequency caused by the hammering operation.

Further, the vibration sensor unit 4 is held on the first housing 11 in a state in which the vibration sensor unit 4 is held between the first and second elastic elements 451 and 453 in the front-rear direction. Therefore, according to the present embodiment, the transmission of the vibrations of the second frequency from the first housing 11 to the vibration sensor unit 4 can be effectively suppressed by the first and second elastic elements 451 and 453 which are disposed across the vibration sensor unit 4 in the front-rear direction. Particularly, compared with an elastic element having a rectangular section, the first and second elastic elements 451 and 453 each having a generally circular section are easier to elastically deform and therefore suitable for suppressing the vibration transmission. It is noted that the sectional shape of each of the first and second elastic elements 451 and 453 may be a slightly distorted circular shape or an ellipse, instead of a complete circle.

The first and second elastic elements 451 and 453 are connected via the connection part 455 to form a single component. In the case of a structure in which the first and second elastic elements 451 and 453 are formed as separate components without being connected together, during the assembling described above, the first elastic element 451, which is first fitted onto the cylindrical part 113, may be hidden by the vibration sensor unit 4. Then, an assembler may not be able to visually check whether the first elastic element 451 is assembled or not. By employing the elastic intervening member 45 of the present embodiment, however, even if the assembler fails to assemble either one of the first and second elastic elements 451 and 453, the assembler can visually recognize the failure immediately. Furthermore, the possibility of losing the first or second elastic element 451 or 453, which is generally small, can be reduced.

In the present embodiment, the motor 2 is arranged such that the rotation axis A2 extends in the direction crossing (specifically, orthogonal to) the driving axis A1. The vibration sensor unit 4 is arranged behind the motor 2 within the range of the length of the motor shaft 25 in the extending direction of the rotation axis A2 (up-down direction). Particularly, like in the present embodiment, in the hammer drill 1, having the driving mechanism 3 using a crank mechanism as the motion converting mechanism 30, and the motor 2 arranged such that the rotation axis A2 extends in the direction crossing the driving axis A1, a free space tends to be formed below the crank mechanism and behind the motor 2. The vibration sensor unit 4 of the present embodiment is disposed by effectively utilizing this free space. Thus, the vibration sensor unit 4 which can easily detect the vibrations resulting from the hammering operation can be rationally arranged.

In the present embodiment, the housing 10 of the hammer drill 1 includes the first housing 11 and the second housing 13, which is elastically connected to the first housing 11 such that the second housing 13 is movable relative to the first housing 11. This so-called vibration-isolating housing structure can effectively suppress transmission of the vibrations of the first housing 11 to the second housing 13, which includes the grip 131 held by the user. Further, in the present embodiment, the structure in which the controller 6 is housed in the second housing 13 (specifically, the lower part 137) can appropriately protect the controller 6, which is a precision apparatus, from all vibrations caused in the first housing 11.

Correspondences between the features of the embodiment and the features of the invention are as follows. The hammer drill 1 is an example that corresponds to the "impact tool" according to the present invention. The driving axis A1 is an example that corresponds to the "impact-axis" according to the present invention. The motor 2, the stator 21, the rotor 22, the motor shaft 25 and the rotation axis A2 are examples that correspond to the "motor", the "stator", the "rotor", the "motor shaft" and the "rotation axis of the motor shaft", respectively, according to the present invention. The driving mechanism 3 (the motion converting mechanism 30 and the striking mechanism 36) is an example that corresponds to the "driving mechanism" according to the present invention. The vibration sensor unit 4 (the sensor body 40) is an example that corresponds to the "vibration sensor" according to the present invention. The first housing 11 is an example that corresponds to the "first housing" according to the present invention. The first elastic element 451 and the second elastic element 453 are examples that correspond to the "at least one elastic element" according to the present invention. The first elastic element 451, the second elastic element 453 and the connection part 455 are examples that correspond to the "first elastic element", the "second elastic element" and the "connection part", respectively, according to the present invention. The second housing 13 and the grip part 131 are examples that correspond to the "second housing" and the "grip part", respectively, according to the present invention. Each of the first springs 71, the second spring 75 and the O-ring 77 is an example that corresponds to "another elastic element" according to the present invention. The controller 6 is an example that corresponds to the "controller" according to the present invention.

Second Embodiment

A hammer drill 100 according to a second embodiment is now described with reference to FIGS. 6 to 11. Like the hammer drill 1 of the first embodiment, the hammer drill 100 of the second embodiment is configured to perform the hammering operation and the drilling operation and includes structures common to the hammer drill 1. Therefore, in the following description, the structures common to the hammer drill 1 are given the same numerals and not described or only briefly described, and different structures are mainly described with reference to the drawings.

Figure 6:
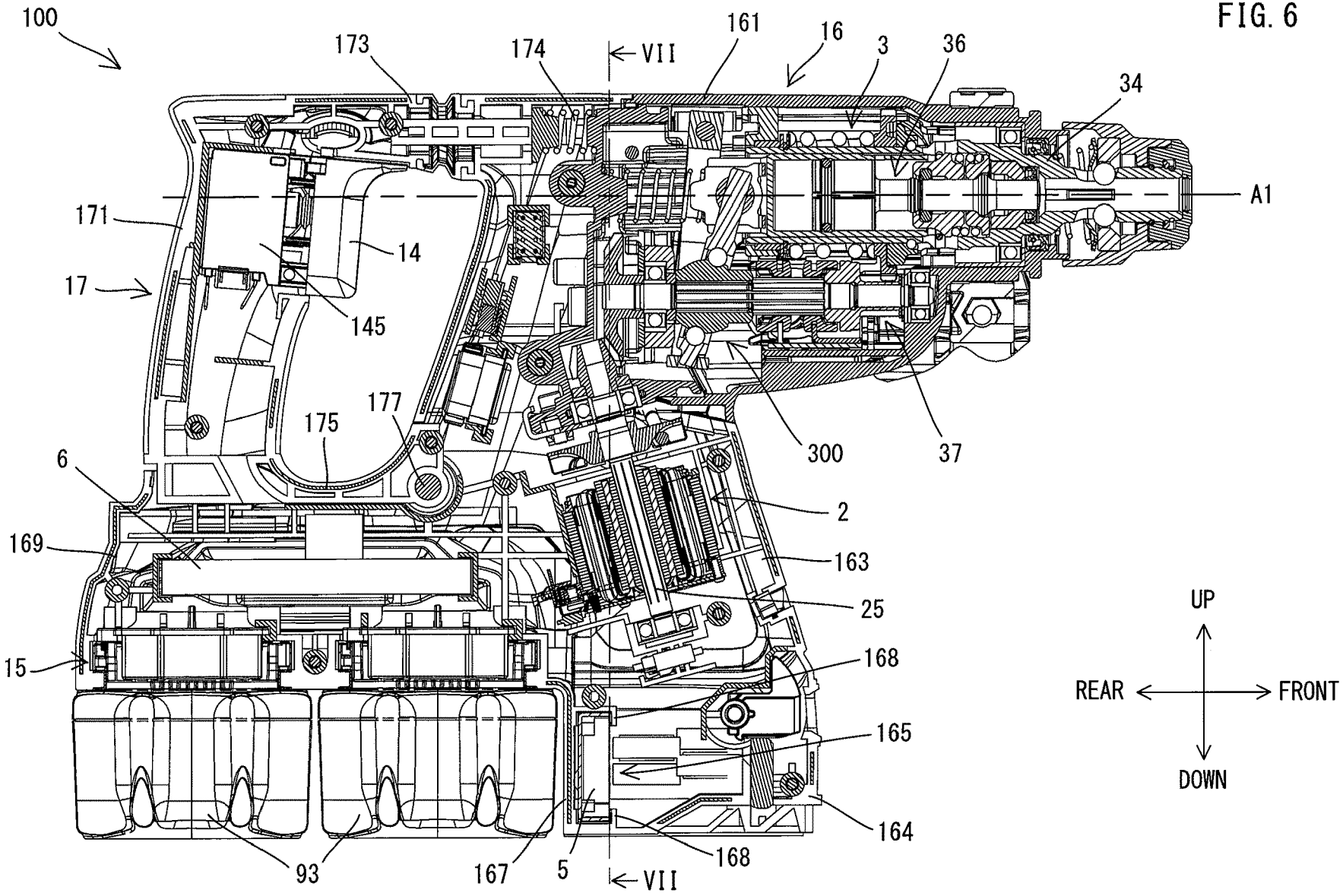
FIG. 6 is a longitudinal section view of a hammer drill according to a second embodiment.

First, the general structure of the hammer drill 100 is described with reference to FIG. 6. As shown in FIG. 6, in the present embodiment, an outer shell of the hammer drill 100 is mainly formed by a body housing 16 and a handle 17.

The body housing 16 and its internal configuration are described. In the present embodiment, the body housing 16 mainly includes three parts, that is, a driving mechanism housing part 161, a motor housing part 163 and a controller housing part 169. The body housing 16 is generally Z-shaped in side view as a whole.

The driving mechanism housing part 161 is a portion of the body housing 16 which extends in the front-rear direction along the driving axis A1. An internal configuration of the driving mechanism housing part 161 is basically similar to the internal configuration of the driving mechanism housing part 117 of the first embodiment (see FIG. 1). Specifically, the driving mechanism housing part 161 has the tool holder 34 in its front end region and houses the driving mechanism 3. The driving mechanism 3 includes a motion converting mechanism 300, the striking mechanism 36 and the rotation transmitting mechanism 37. In the first embodiment, the motion converting mechanism 30 is configured as a crank mechanism, but in the present embodiment, the motion converting mechanism 300 including a swinging member is employed. The structure of the motion converting mechanism 300 is well known and is therefore not described here.

The motor housing part 163 is a portion of the body housing 16 which is connected to a rear end portion of the driving mechanism housing part 161 and generally extends in the up-down direction. The motor 2 is housed in a central portion of the motor housing part 163 in the up-down direction. Unlike in the first embodiment, the motor 2 is arranged such that the rotation axis of the motor shaft 25 extends in a direction obliquely crossing the driving axis A1. More specifically, the rotation axis of the motor shaft 25 extends obliquely forward and downward with respect to the driving axis A1. Therefore, the power is transmitted from the motor shaft 25 to the motion converting mechanism 300 and the rotation transmitting mechanism 37 via bevel gears, not via spur gears.

The controller housing part 169 is a portion of the body housing 16 which extends rearward from a generally central portion (in which the motor 2 is housed) of the motor housing part 163 in the up-down direction. The controller 6 is housed in the controller housing part 169. Further, the two battery mounting parts 15 are provided on a lower side of the controller housing part 169. Like in the first embodiment, the two battery mounting parts 15 are arranged side by side in the front-rear direction.

A lower end part 164 of the motor housing part 163 is configured to be arranged in front of the battery 93 such that a lower surface of the lower end part 164 is generally flush with the lower surface of the battery 93 when the battery 93 is mounted to the battery mounting part 15. The lower end part 164 may also serve as a battery protection part for protecting the battery 93 from external forces. The lower end part 164 is provided to extend on the lower side of the motor 2 in order to secure the stability of the hammer drill 100 when the hammer drill 100 is placed on a flat surface and to protect the battery 93 from the external forces. An internal space of the lower end part 164 having such a structure tends to become a dead space. Therefore, in the present embodiment, this dead space is effectively utilized to dispose a vibration sensor unit 5. The structure of the vibration sensor unit 5 and a structure for holding the vibration sensor unit 5 will be described later in detail.

The handle 17 is now described. The handle 17 includes a grip part 171, an upper connection part 173 and a lower connection part 175. The handle 17 is substantially C-shaped as a whole. The grip part 171 is a portion that is arranged apart rearward from the body housing 16 and extends generally in the up-down direction. The trigger 14 and the switch 145 are provided in the grip part 171. The upper connection part 173 is a portion that extends forward from an upper end portion of the grip part 171 and is connected to an upper rear end portion of the body housing 16. The lower connection part 175 is a portion that extends forward from a lower end portion of the grip part 171 and is connected to a central rear end portion of the body housing 16. Further, the lower connection part 175 is disposed on an upper side of the controller housing part 169.

In the present embodiment, the handle 17 is elastically connected to the body housing 16 such that the handle 17 is movable relative to the body housing 16. More specifically, a biasing spring 174 is disposed between a front end portion of the upper connection part 173 and a rear end portion of the driving mechanism housing part 161. The lower connection part 175 is rotatably supported relative to the motor housing part 163 via a support shaft 177 extending in the left-right direction. With such a structure, transmission of vibrations from the body housing 16 to the handle 17 (the grip 171) can be suppressed.

The structure of the vibration sensor unit 5 and the structure for holding the vibration sensor unit 5 are now described.

Figure 7:
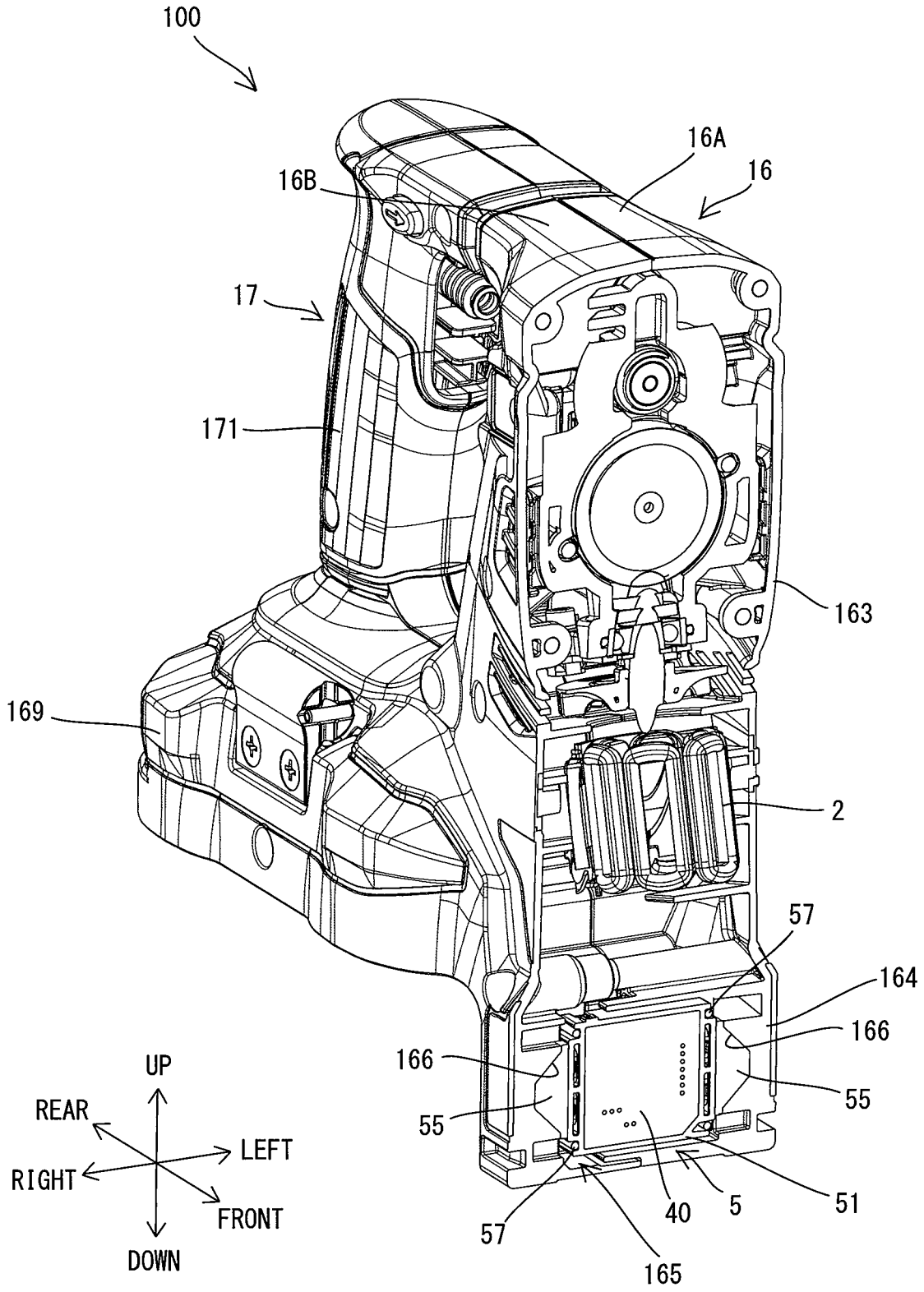
FIG. 7 is a perspective view of a cross section taken along line VII-VII in FIG. 6.

As shown in FIG. 7, the vibration sensor unit 5 includes a sensor body 40 which is generally identical to that of the vibration sensor unit 4 of the first embodiment, and a holding member 51 for holding the sensor body 40. Further, the vibration sensor unit 5 is held on the lower end portion 164 of the motor housing part 163 via two elastic intervening members 55 which are engaged with right and left end portions of the holding member 51.

Figure 8:
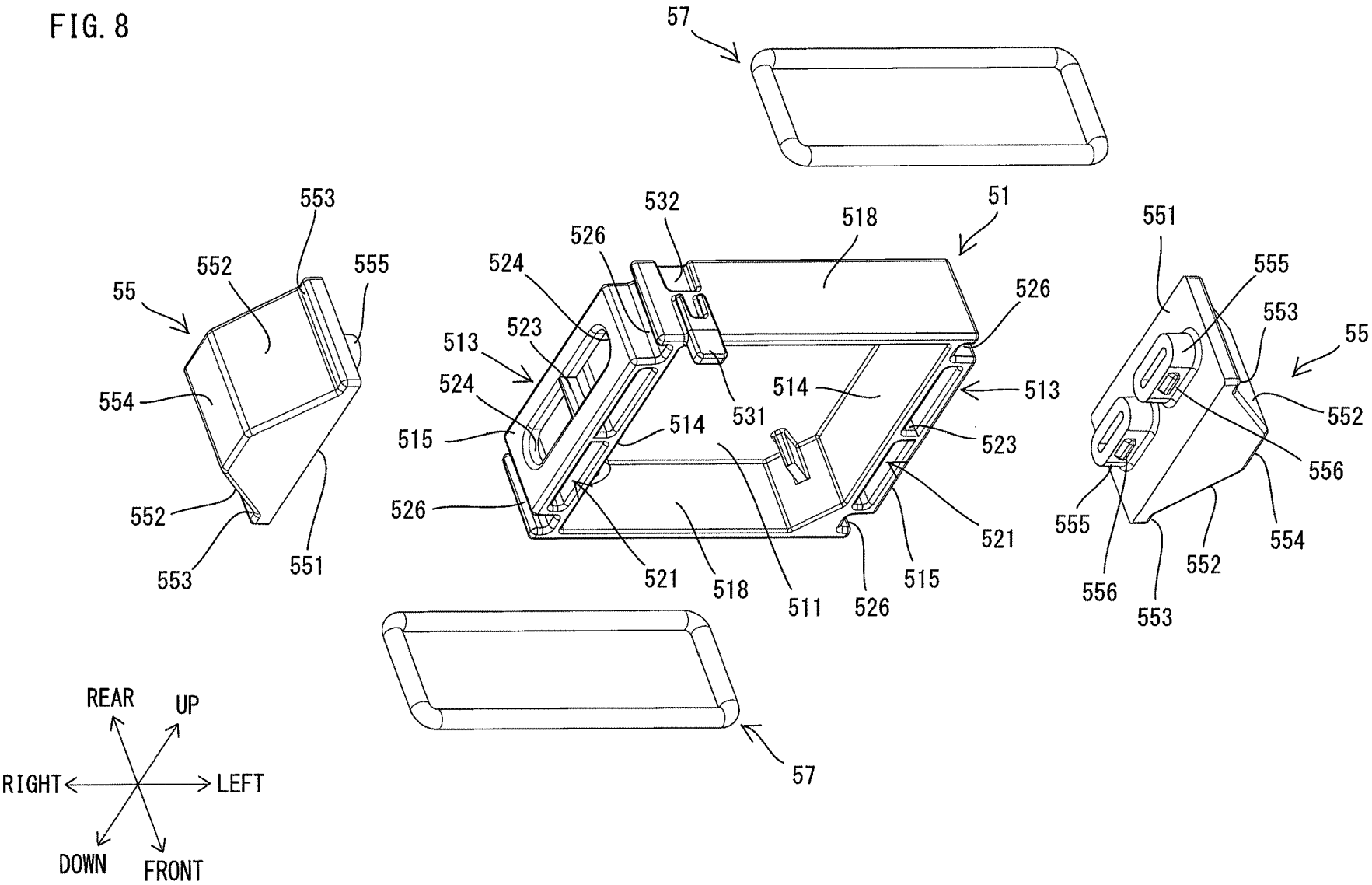
FIG. 8 is an exploded perspective view for illustrating a holding member, elastic intervening members and elastic rings.

As shown in FIG. 8, in the present embodiment, the holding member 51 has a rectangular parallelepiped box-like shape which is longer in the left-right direction and has an open front, as a whole. More specifically, the holding member 51 has a rear wall (bottom wall) 511 and a peripheral wall which protrudes forward from an outer edge of the rear wall 511 and surrounds the outer edge. The peripheral wall includes a pair of right and left double walls 513 and a pair of upper and lower side walls 518. The sensor body 40 is held in a recess which is defined by the rear wall 511 and the peripheral wall (see FIG. 10).

Each of the double walls 513 forming right and left end portions of the holding member 51 is configured to engage with the elastic intervening member 55 described below. More specifically, each of the double walls 513 has an inner wall 514, an outer wall 515 and a space 521 formed between the inner wall 514 and the outer wall 515. The outer wall 515 is shorter than the inner wall 514 in the up-down direction, and upper and lower end portions of the outer wall 515 are connected to the inner wall 514. Further, the inner wall 514 and the outer wall 515 have open front and rear ends. With such a structure, the space 521 between the inner wall 514 and the outer wall 515 is formed as a through hole which extends through the double wall 513 in the front-rear direction. Further, a partition wall 523 is provided between the inner wall 514 and the outer wall 515 and partitions the space 521 into two regions in the up-down direction. Two openings 524 are formed in the outer wall 515. The two openings 524 are disposed on upper and lower sides of the partition wall 523. The openings 524 communicatively connect the space 521 and the outside of the holding member 51. Engagement projections 555 of the elastic intervening member 55 described below are fitted into the openings 524.

Recesses 526 are formed in four corners of the holding member 51. More specifically, right and left end portions of each of the upper and lower side walls 518 are formed to protrude outward (to the outer wall 515 side) in the left-right direction from the right and left inner walls 514, respectively. The recesses 526 are defined by the right and left end portions of the side walls 518 and the upper and lower end portions of the double walls 513 and recessed inward in the left-right direction. An elastic ring 57 is held in the recesses 526 when mounted on an outer periphery of the holding member 51.

Figure 9:
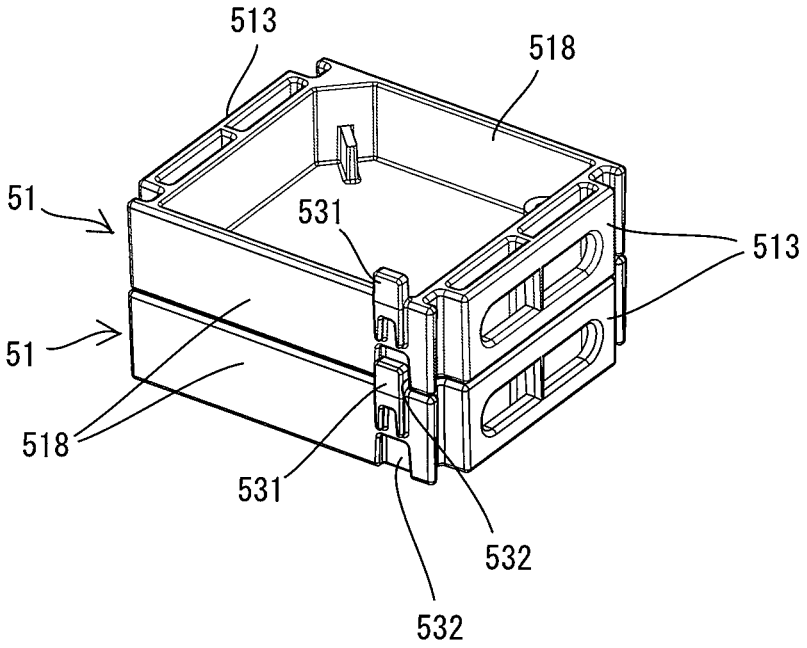
FIG. 9 is a perspective view of holding members stacked one on the other.

The sensor body 40 (see FIG. 10) which is held by the holding member 51 needs to be mounted to the body housing 16 (the motor housing part 163) in a proper orientation in order to accurately detect the vibrations resulting from the hammering operation. Therefore, the holding member 51 is provided with a projection 531 as a mark for matching the orientation of the holding member 51 with respect to the body housing 16 (the motor housing part 163). More specifically, the projection 531 protrudes forward from a right front end of the upper side wall 518. Further, an engagement recess 532 having a shape corresponding to the projection 531 is formed in the upper side wall 518, behind the projection 531. With such a structure, before assembling the sensor body 40 to the holding member 51, as shown in FIG. 9, a plurality of the holding members 51 can be stacked one on the other with the projection 531 of one holding member 51 engaged with the engagement recess 532 of the other holding member 51. Thus, a space required for the holding members 51 during transporting or storing can be reduced, and the possibility of damage to the projection 531 can be reduced.

As shown in FIG. 8, in the present embodiment, each of the elastic intervening members 55 as a whole has a prismatic shape having a generally isosceles trapezoidal bottom. A side surface having the largest area among the side surfaces of the prism (a side surface corresponding to a bottom side of the trapezoid) is arranged to be in contact with an outer surface of the double wall 513 (specifically, the outer wall 515) when the elastic intervening member 55 is engaged with the holding member 51. The side surface is hereinafter referred to as a contact surface 551. Two side surfaces corresponding to legs of the trapezoid form a pair of inclined surfaces 552 which are inclined toward each other, as the inclined surfaces 552 extend further away from the contact surface 551. Further, a stepped part is formed between the contact surface 551 and each of the inclined surfaces 552. The stepped part includes a surface 553 which is parallel to the contact surface 551. A side surface corresponding to a top side of the trapezoid and parallel to the contact surface 551 forms a protruding end surface 554 when the elastic intervening member 55 is engaged with the holding member 51. Further, the elastic intervening member 55 has generally the same length in the up-down direction as the outer wall 515 and has a larger width in the front-rear direction than the holding member 51.

Figure 10:
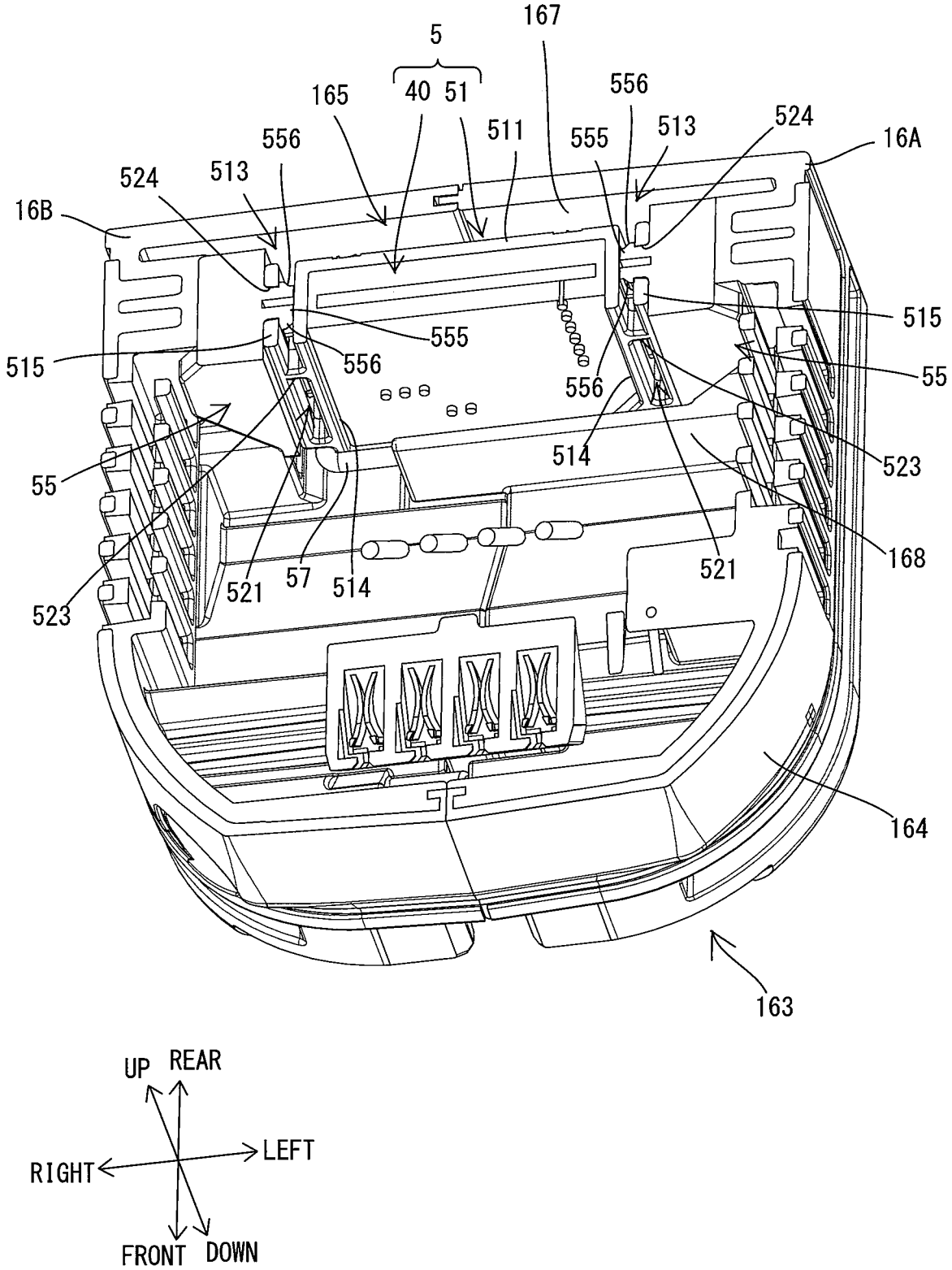
FIG. 10 is a perspective view of a cross section of a lower end portion of a motor housing part.

Two engagement projections 555 protrude from the contact surface 551. The two engagement projections 555 are configured to be respectively fitted in the two openings 524 formed in the outer wall 515. Further, locking pieces 556 are provided on front and rear surfaces of the engagement projection 555 and protrude forward and rearward, respectively. As shown in FIG. 10, the front and rear locking pieces 556 are symmetrically arranged with respect to a center line of the engagement projection 555 in the front-rear direction. Each of the locking pieces 556 has a triangular section, and has an inclined surface and a locking surface. The inclined surface is inclined outward from a protruding end side toward a base side of the engagement projection 555. The locking surface connects the inclined surface and the engagement projection 555 and extends generally in parallel to the contact surface 551.

The whole of the elastic intervening member 55 having the above-described structure is integrally formed of rubber as one component, including the engagement projections 555 and the locking pieces 556. The two elastic intervening members 55 are respectively engaged with the right and left double walls 513 by fitting the two engagement projections 555 of each of the two elastic intervening members 55 in the two openings 524 of each of the right and left outer walls 515. When the engagement projection 555 is fitted in the opening 524, the locking pieces 556 pass through the openings 524 while elastically deforming and are disposed within the space 521. When the locking pieces 556 are elastically restored within the space 521, the locking surfaces of the locking pieces 556 are held in contact with an inner surface of the outer wall 515, so that the engagement projection 555 is prevented from slipping out from the opening 524. The two elastic intervening members 555 engaged with the right and left double walls 513 protrude rightward and leftward, respectively. The inclined surfaces 552 of the elastic intervening member 55 are arranged to be inclined toward each other in the up-down direction as the inclined surfaces 552 extend further away from the vibration sensor unit 5 in the left-right direction. Further, the surfaces 553 of the stepped part and the protruding end surface 554 which extend in parallel to the contact surface 551 are arranged orthogonally to the left-right direction.

As shown in FIG. 8, the elastic ring 57 is an annular member formed of an elastic material (such as rubber). In the present embodiment, the two elastic rings 57 are mounted on the outer periphery of the holding member 51. One of the elastic rings 57 is engaged with the two recesses 526 formed in right and left upper end portions of the holding member 51 and mounted to surround an outer periphery of an upper end portion of the holding member 51. The other elastic ring 57 is engaged with the two recesses 526 formed in right and left lower end portions of the holding member 51 and mounted to surround an outer periphery of a lower end portion of the holding member 51. When the elastic rings 57 are mounted on the holding member 51, portions of each of the elastic rings 57 is arranged on front and rear sides of the holding member 51.

Figure 11:
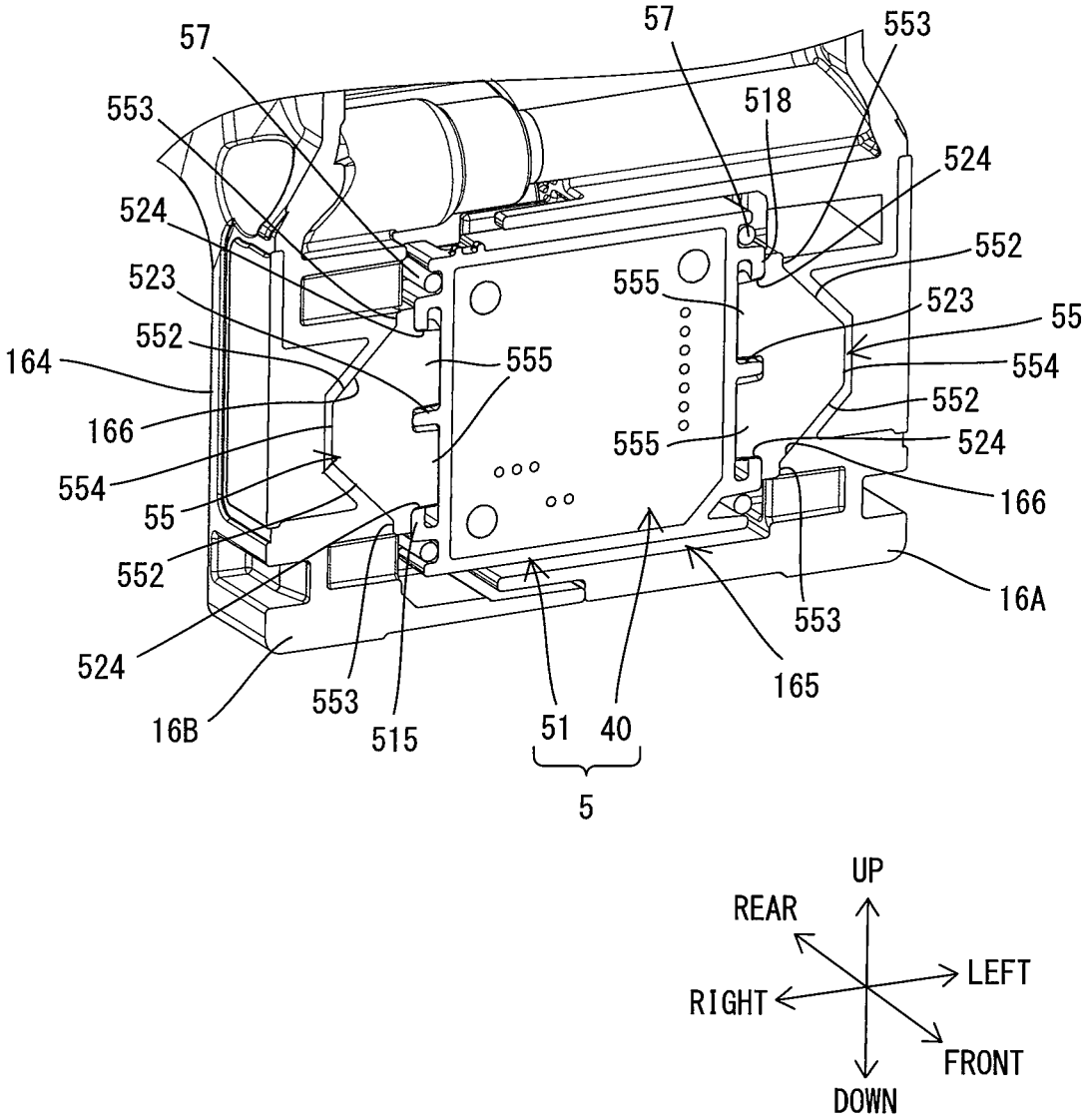
FIG. 11 is a perspective view of a cross section of the lower end portion of the motor housing part.

As shown in FIGS. 6, 10 and 11, a sensor holding part 165 for holding the vibration sensor unit 5 is formed in a rear end portion of the lower end part 164 of the motor housing part 163. The sensor holding part 165 is formed as a recess having an open front. Further, right and left end portions of the sensor holding part 165 are respectively formed as fitting parts 166 in which the elastic intervening members 55 mounted to the right and left end portions (the double walls 513) of the holding member 51 can be fitted. More specifically, each of the fitting parts 166 is defined by inclined surfaces which are inclined toward each other in the up-down direction as they extend outward in the left-right direction so as to correspond to the inclined surfaces 552 of the elastic intervening member 55, and a surface which extends orthogonally to the left-right direction so as to correspond to the protruding end surface 554 of the elastic intervening member 55.

The elastic intervening member 55 is fitted in the fitting part 166 while being compressed both in the up-down direction and the left-right direction. Thus, the elastic intervening member 55 is engaged with the body housing 16 (the motor housing part 163) via the inclined surfaces 552 both in the up-down direction and the left-right direction. In other words, the vibration sensor unit 5 is connected to the body housing 16 via the elastic intervening members 55 both in the up-down direction and the left-right direction. With such a structure, vibrations in the up-down direction and vibrations in the left-right direction (typically, vibrations in different directions from the vibrations in the direction of the driving axis A (the front-rear direction) caused by the hammering operation) can be effectively prevented from being transmitted from the motor housing part 163 to the vibration sensor unit 5. Further, when the elastic intervening members 55 is fitted in the fitting part 166, the surfaces 553 of the stepped parts which are formed contiguously to the inclined surfaces 552 in upper and lower end portions of the elastic intervening member 55 are held in contact with right and left wall surfaces which define the sensor holding part 165, at upper and lower sides of the fitting part 166. With such a structure, the vibration sensor unit 5 can be prevented from rotating relative to the motor housing part 163 around an axis extending in the front-rear direction.

Further, a movement of each of the elastic intervening members 55 in the front-rear direction is restricted by a rear wall 167 of the sensor holding part 165 and a pair of ribs 168 extending in the left-right direction along upper and lower front ends of the sensor holding part 165. As described above, the width of the elastic intervening member 55 in the front-rear direction is set to be larger than the holding member 51, so that the vibration sensor unit 5 is spaced apart from the rear wall 167 and the ribs 168 (see FIG. 10). Further, portions of each of the elastic rings 57 mounted on the holding member 51 is disposed between the rear wall 167 and the vibration sensor unit 5 (the holding member 51) and between the ribs 168 and the vibration sensor unit 5 (the holding member 51). With such a structure, the vibration sensor unit 5 is allowed to move in the front-rear direction relative to the motor housing part 163. The elastic rings 57 allow the vibration sensor unit 5 to be moved in the front-rear direction relative to the motor housing part 163, for example, due to the hammering operation of the driving mechanism 3, while preventing the relative movement exceeding a prescribed amount.

Further, in the present embodiment, the motor housing part 163 is formed by right and left halves (hereinafter referred to as a left shell 16A and a right shell 16B) connected together along the driving axis A1 (see FIG. 1). Therefore, the vibration sensor unit 5 can be easily disposed within the sensor holding part 165 by connecting the left and right shells 16A, 16B to each other with the two elastic intervening members 55 engaged with the right and left end portions of the vibration sensor unit 5 and fitted in the fitting parts 166 of the left and right shells 16A, 16B, respectively. At this time, the elastic intervening member 55 and the sensor holding part 165 (the fitting part 166) are connected to each other via the pair of inclined surfaces which are inclined toward each other in the up-down direction as the inclined surfaces extend outward in the left-right direction, so that the elastic intervening member 55 can be easily fitted in the fitting part 166 while being compressed in the up-down direction and the left-right direction and can be easily positioned in the up-down direction and the left-right direction.

Like the vibration sensor unit 4 of the first embodiment, the vibration sensor unit 5 is held in the lower end part 164 of the motor housing part 163 via the elastic intervening members 55 having the above-described structure such that the vibration sensor can detect, among the vibrations caused in the first housing 11, the vibrations of the first frequency which are caused by the hammering operation of the driving mechanism 3 (specifically, the vibrations of frequency bands having a prescribed width and centered on the hammering frequency and its order components), and such that transmission of the vibrations of the second frequency which are caused by the electromagnetic vibrations of the motor 2 (specifically, the vibrations of frequency bands having a prescribed width and centered on the electromagnetic vibration frequency and its order components) is suppressed. In other words, the vibrations of the first frequency which are caused by the hammering operation can be reliably transmitted to the sensor body 40, while the sensor body 40 is protected from the vibrations of the second frequency which are caused by the electromagnetic vibrations of the motor 2. In this manner, also in the present embodiment, the sensor body (the vibration sensor) 40 can be rationally protected.

Correspondences between the features of the embodiment and the features of the invention are as follows. The hammer drill 100 is an example that corresponds to the "impact tool" according to the present invention. The vibration sensor unit 5 (the sensor body 40) is an example that corresponds to the "vibration sensor" according to the present invention. The body housing 16 is an example that corresponds to the "first housing" according to the present invention. The elastic rings 57 and the elastic intervening members 55 are examples that correspond to the "at least one elastic element". The two elastic intervening members 55 are examples that correspond to the "pair of elastic elements" according to the present invention. The grip part 171 is an example that corresponds to the "grip part" according to the present invention. The pair of inclined surfaces 552 are examples that correspond to the "pair of inclined surfaces" according to the present invention.

The above-described embodiments are merely examples. The impact tool according to the present invention is not limited to the structures of the above-described hammer drills 1, 100. For example, the following modifications or changes may be made. Further, one or more of these modifications may be used in combination with the hammer drills 1 or 100 of the embodiments, or the claimed invention.

For example, in the above-described embodiments, the hammer drills 1 and 100 which are capable of performing not only the hammering operation but also the drilling operation are described as examples of the impact tool, but the impact tool may be an electric hammer which is capable of performing only the hammering operation (namely, which includes the driving mechanism 3 without the rotation transmitting mechanism 37). Further, although the motion converting mechanism 30 including a crank mechanism is employed in the driving mechanism 3 of the hammer drill 1, the motion converting mechanism including a swinging member may be employed. On the other hand, the motion converting mechanism 300 including a crank mechanism may be employed in the hammer drill 100.

The motor 2 of the above-described embodiments is configured as an embedded magnet type eight-pole brushless motor, but the type of the motor 2 and the number of poles of the motor 2 are not so limited. For example, the motor 2 may be configured as a surface magnet type brushless motor. Further, when the embedded magnet type brushless motor is employed, the arrangement and the embedding method of the permanent magnets 221 may be appropriately modified.

As described above, the electromagnetic vibration frequency of the motor 2 is defined according to the number of poles formed in the rotor 22. Therefore, the number, material, shape, elastic modulus and other factors of the elastic intervening members 45, 55, and the elastic rings 57 for holding the vibration sensor unit 4, 5 may be changed, depending on the electromagnetic vibration frequency corresponding to the number of poles of the motor to be used. For example, only one elastic intervening member 45 may be provided, or the elastic intervening member 45 may be formed of an elastic element (such as a spring) other than rubber. Further, the first and second elastic elements 451 and 453 do not necessarily have to be connected by the connection part 455 to form a single component, but may be arranged on front and rear sides of the vibration sensor unit 4 as two separate components. In place of the elastic intervening member 45, for example, a hydraulic damper or other similar member may be employed. In any case, the vibration sensor unit 4 only needs to be arranged such that it can detect the vibrations caused by the hammering operation and such that transmission of the vibrations caused by the electromagnetic vibrations is suppressed. Further, the elastic intervening member 45 or other mechanisms may suppress transmission of vibrations caused by factors other than the electromagnetic vibrations (that is, vibrations of a different frequency from the electromagnetic vibration frequency). Similarly, the elastic ring 57 and the elastic intervening member 55 may also be appropriately modified.

Like the modifications of the elastic intervening member 45, 55, and the elastic rings 57, the structure and positioning of the vibration sensor unit 4, 5 are not limited to those of the above-described embodiments, but may be appropriately modified. For example, in the first embodiment, the vibration sensor unit 4 is arranged within the range of the length of the motor shaft 25 in the up-down direction in its entirety, but the vibration sensor unit 4 may be arranged to partially protrude upward from an upper end or downward from a lower end of the motor shaft 25. Further, for example, the vibration sensor unit 4 may be held not on the inner wall 112 of the motor housing part 111 but on a rear wall of the driving mechanism housing part 117. In this case, the vibration sensor unit 4 may be arranged outside the range of the length of the motor shaft 25 in the up-down direction in its entirety. Further, the vibration sensor unit 5 of the second embodiment may be disposed anywhere else within the motor housing part 163 or may be disposed within the controller housing part 169.

In the first embodiment, the housing 10 is configured as a vibration-isolating housing including the first housing 11 and the second housing 13, but does not necessarily have to be a vibration-isolating housing. Further, the structure of elastically connecting the first housing 11 and the second housing 13 may be appropriately modified. In the above-described embodiments, the grip part 131 is configured as a portion of the second housing 13, but, for example, only a grip part (handle) configured to be held by a user may be connected to a housing part which houses the motor 2 and the driving mechanism 3, via an elastic element. In view of protection from vibrations, it may be preferable for the controller 6, which is a precision apparatus, to be housed in the second housing 13, but the controller 6 may be housed in the first housing 11.

DESCRIPTION OF NUMERALS

1, 100: hammer drill, 10: housing, 11: first housing, 111: motor housing part, 112: inner wall, 113: cylindrical part, 114: threaded hole, 115: recess, 117: driving mechanism housing part, 13: second housing, 131: grip, 133: upper part, 137: lower part, 138: front lower end part, 139: rear lower end part, 14: trigger, 145: switch, 15: battery mounting part, 16: body housing, 161: driving mechanism housing part, 163: motor housing part, 164: lower end part, 165: sensor holding part, 166: fitting part, 167: rear wall, 168: rib, 169: controller housing part, 17: handle, 171: grip, 173: upper connection part, 174: biasing spring, 175: lower connection part, 177: support shaft, 2: motor, 21: stator, 22: rotor, 221: permanent magnet, 25: motor shaft, 29: driving gear, 3: driving mechanism, 30, 300: motion converting mechanism, 31: crank shaft, 32: connecting rod, 33: piston, 34: tool holder, 35: cylinder, 36: striking element, 361: striker, 363: impact bolt, 365: air chamber, 37: rotation transmitting mechanism, 38: clutch, 39: mode switching dial, 4: vibration sensor unit, 40: sensor body, 41: holding member, 411: holding part, 413: arm part, 415: through hole, 45: elastic intervening member, 451: first elastic element, 453: second elastic element, 455: connection part, 47: washer, 48: screw, 5: vibration sensor unit, 51: holding member, 511: rear wall, 513: double wall, 514: inner wall, 515: outer wall, 518: side wall, 521: space part, 523: partition wall, 524: opening, 526: recess, 531: projection, 532: engagement recess, 55: elastic intervening member, 551: contact surface, 552: inclined surface, 553: surface, 554: protruding end surface, 555: engagement projection, 556: locking piece, 57: elastic ring, 6: controller, 71: first spring, 75: second spring, 77: O-ring, 81: upper sliding part, 82: lower sliding part, 91: tool accessory, 93: battery, A1: driving axis, A2: rotation axis

What is claimed is:

1. An impact tool configured to linearly drive a tool accessory, the impact tool comprising:

a motor;

a driving mechanism configured to perform a hammering operation of linearly driving the tool accessory along an impact-axis by power of the motor, the impact-axis extending in a front-rear direction of the impact tool;

a vibration sensor configured to detect vibrations; and a first housing that houses the motor and the driving mechanism; wherein:

the vibration sensor is disposed such that the vibration sensor is capable of detecting vibrations of a first frequency among vibrations caused in the impact tool, and such that transmission of vibrations of a second frequency to the vibration sensor is suppressed, the vibrations of the first frequency resulting from the hammering operation, and the second frequency being different from the first frequency;

the vibration sensor is held on the first housing via at least one elastic element;

the at least one elastic element includes a first elastic element and a second elastic element; and the vibration sensor is held on the first housing while being held between the first elastic element and the second elastic element in the front-rear direction.

2. The impact tool as defined in claim 1, wherein:

the motor is configured as a brushless motor including a stator, a rotor and a motor shaft extending from the rotor, the vibrations of the second frequency are vibrations resulting from electromagnetic vibrations of the motor, and the second frequency is a frequency that is defined according to the number of poles formed in the rotor.

3. The impact tool as defined in claim 2, wherein:

the motor is arranged such that a rotation axis of the motor shaft extends in a direction crossing the impact-axis, and the vibration sensor is at least partly disposed within a range of a length of the motor shaft in an extending direction of the rotation axis.

4. The impact tool as defined in claim 3, wherein the vibration sensor is disposed behind the motor in the front-rear direction.

5. The impact tool as defined in claim 1, wherein the first elastic element and the second elastic element are connected via a connection part.

6. The impact tool as defined in claim 1, further comprising a grip part configured to be held by a user, wherein the grip part is connected to the first housing via another elastic element such that the grip part is movable relative to the first housing.

7. The impact tool as defined in claim 1, further comprising:

a second housing connected to the first housing via another elastic element such that the second housing is movable relative to the first housing, and a controller configured to control driving of the motor based on a detection result of the vibration sensor, wherein:

the controller is housed in the second housing.

* * * * *